US005979349A

United States Patent [19]

Dickman

[11] Patent Number: 5,979,349

[45] Date of Patent: Nov. 9, 1999

[54] BOAT LIFT METHOD

[76] Inventor: Joseph Dickman, 21081 Five Point Rd., Batesville, Ind. 47006

[21] Appl. No.: 09/248,744

[22] Filed: Feb. 12, 1999

[51] Int. Cl.[6] ..... B63B 35/42

[52] U.S. Cl. ..... 114/45; 405/3

[58] Field of Search ..... 114/44–48, 50–54, 114/265; 405/3–5

[56] References Cited

U.S. PATENT DOCUMENTS 3,603,276 9/1971 DeLisle ..... 114/45

4,509,446 4/1985 Sutton ..... 114/45

*Primary Examiner*—Jesus D. Sotelo

*Attorney, Agent, or Firm*—Daniel J. O'Connor

[57] ABSTRACT

A boat lift method and design which enables a boat to be efficiently stored above water at a dock location to prevent algae and dock damage to a boat. The design minimizes listing of the boat lift during use and thus reduces potential damage to the dock and the lift itself. Listing is minimized via a dual system which uses a specially designed buoyant tank and a jackscrew at one end of the boat lift. The system may be easily used for wide-spread commercial appeal in the boat storing arts.

3 Claims, 1 Drawing Sheet

BOAT LIFT METHOD

BACKGROUND AND OBJECTS OF THE INVENTION

The present invention is generally related to the boat lifting arts and, in particular, to a novel method and apparatus to prevent and minimize listing during operation and use of a boat lift.

Boat lifts used to store a boat above water in a docking area have been known in the prior art as illustrated by U.S. Pat. No. 5,394,814.

The problems encountered with such boat lifts include cost of manufacture and damage to the dock and/or lift due to listing of the boat lift.

Accordingly, it is an object of the present invention to set forth a novel boat lift method and design which minimizes listing during use and operation. Such reduces dock and lift damage and contributes to the overall efficiency of the device.

It is a further object of the invention to demonstrate a boat lift method which may be readily used by persons to store boats, jet-skis, etc. above water to prevent algae damage.

It is also an object of the invention to show a unique boat lift method and design which may be economically manufactured for widespread commercial appeal.

These and other objects and advantages of the invention will be apparent to those of skill in the art from the description which follows.

SUMMARY OF THE INVENTION

Side-to-side listing of a boat lift is minimized by utilizing a lower support tank having an air supply to a central part of the tank.

An air supply tube may be adjusted up or down by means of an access port on the side of the tank. Thus, the lift level may be easily controlled.

A second anti-listing device comprising a jackscrew is used on a forward portion of the boat lift.

The overall design improves the efficiency of a boat lift by reducing potential dock and lift damage by minimizing listing.

The system is easily and economically used to store a boat above water thus preventing water damage to the craft while in storage.

BRIEF DESCRIPTION OF THE DRAWING FIGURES

The jackscrew usage is indicated in both figures.

DESCRIPTION OF A PREFERRED EMBODIMENT

Figure 1:
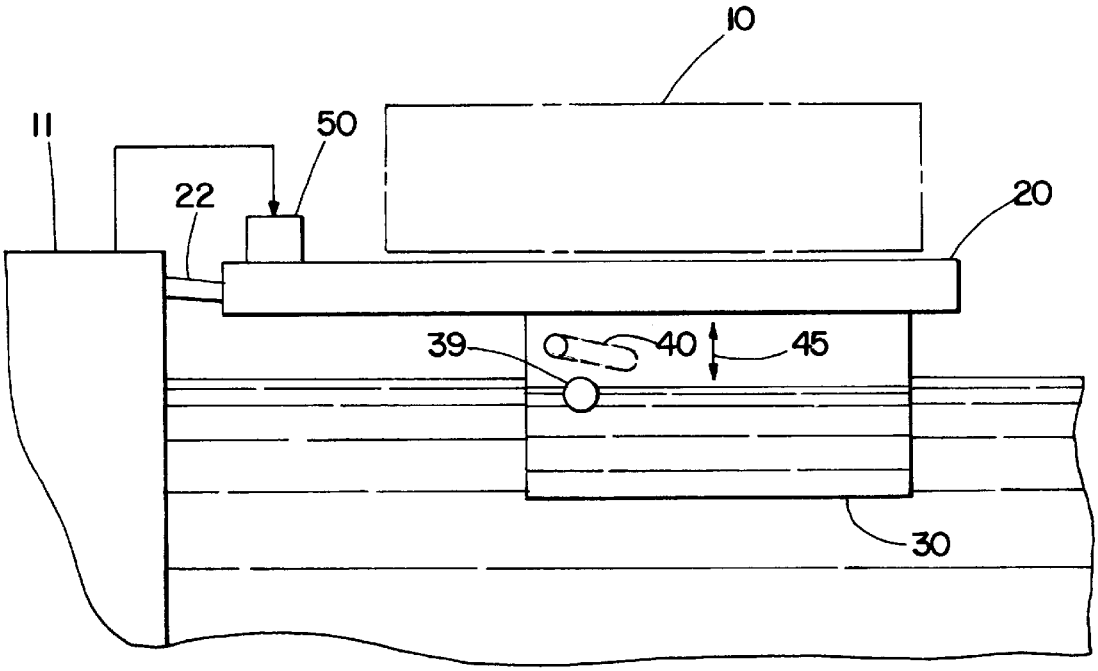
FIG. 1 is a side schematic view of the system and shows the supported boat, the lift and supporting tank in relation to a dock. The air inlet port and the access port are indicated on the side of the tank.
Figure 2:
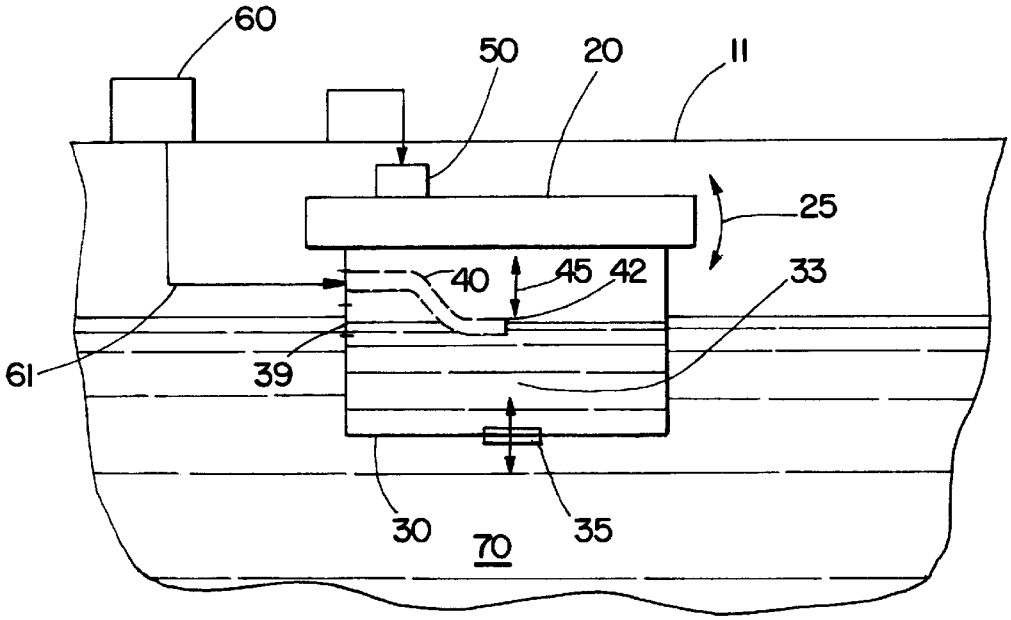
FIG. 2 is an end or rear view of the system and shows schematically the extension of the air tube to a central part of the tank to minimize listing during the raising and lowering process.

Referring to FIGS. 1 and 2, a boat 10 is shown at a dock 11. The boat is supported by a lift 20.

The lift 20 is raised or lowered by means of a bouyant plastic tank 30.

The levels of air and water within tank 30 are controlled by means of tube 40. The position of tube 40 may be adjusted up or down, as indicated by arrow 45, by means of an access port 39. One end of the tube 40 extends to a central part of the tank at 33. Such central location is needed to maintain a uniform volume of air in the tank to counter listing. It is to be understood that access port 39 has a removable and replaceable cap or cover of a type known in the mechanical arts.

A jackscrew mechanism 50 which is attached to dock 11 is applied to the lift 20 so that the leveling of the lift 20 may be further achieved to minimize listing.

The invention method thus comprises a dual list-prevention system by utilizing the buoyant tank design of tank 30 and the jackscrew usage.

Thus, damaging torque forces on the dock and the attaching element 22 may be effectively avoided.

The listing problem previously referred to is indicated by arrows 25 in FIG. 2.

Any rocking motion of the lift 20 may cause damage to the attaching element 22, shown in FIG. 1, or the dock 11.

Such damage of course needs to be avoided and thus the minimization of listing is an important aspect of the invention.

As indicated in the rear view of FIG. 2, air is supplied to or removed from the tank 30 via a blower 60 and line 61. FIG. 2 further shows the central part 33 of the tank in which the end 42 of tube 40 terminates.

FIG. 2 further indicates schematically the position of the jackscrew 50 in relation to the dock and the lift 20 to further minimize listing once the boat lift is at an elevated position.

Water inflow and outflow for the tank 30 may be achieved by means of a valve 35 of a type known in the mechanical arts. Such is shown in FIG. 2.

As will be appreciated in the art, when tank 30 has a greater depth of water therein, the tank and lift 20 are at a lower submerged level 70.

As air is added to the tank via line 40 and the water level falls, the buoyant effect raises the tank lift and boat to an upper storage level.

As previously noted, the position of tube 40 may be readily adjusted by means of the access port 39.

While a particular method and system configuration has been described and illustrated, it is intended in this specification to broadly cover all equivalent methods and structures which would reasonably occur to those of skill in the art.

I claim:

1. A method of lifting and storing a boat above water at a dock location to reduce algae damage comprising the steps of:

providing a lift structure(20) for a boat(10), providing a tank(30) under said lift structure with air and water levels in said tank being adjustable to raise and lower said lift, said tank having an access port(39) on one side thereof, said tank further having an air supply port on a side thereof and an air supply tube(40) extending to a central portion(33) of said tank, wherein the level of said air supply tube may be adjusted by means of said access port, means wherein side-to-side listing of said lift is minimized, said method further comprising the step of providing a jackscrew at a forward portion of said lift to further minimize listing.

2. A tank means(30) for use with a boat lift(20) to prevent listing of the lift, said tank having plural plastic walls and an air tube(40) extending from one of said walls to a central part(33) of said tank, said tank further including an access port means(39) for adjusting said air tube(40), said tank structure providing anti-listing means when used in a boat lift configuration.

3. A method of boat lifting and storage which includes a lower lift(20) and supporting tank(30) comprising the steps of:

providing that said tank has tube means(40) to minimize listing, utilizing a dock-attached jackscrew mounted to a front portion of said lift to further reduce and minimize listing.

* * * * *